United States Patent [19]

Hirose

[11] Patent Number: 4,724,853

[45] Date of Patent: Feb. 16, 1988

[54] METHOD AND APPARATUS FOR DECONTAMINATING SOLID SURFACE

[75] Inventor: Yasuo Hirose, Hitachi, Japan

[73] Assignee: Hitachi, Ltd., Tokyo, Japan

[21] Appl. No.: 683,613

[22] Filed: Dec. 19, 1984

[30] Foreign Application Priority Data

Dec. 23, 1983 [JP] Japan ..... 58-243348

[51] Int. Cl.[4] ..... B08B 3/12

[52] U.S. Cl. ..... 134/1; 134/7; 134/184; 51/7; 51/17; 51/317; 422/209; 422/210

[58] Field of Search ..... 134/1, 7, 184; 51/17, 51/7, 317; 422/209, 210; 209/3

[56] References Cited

U.S. PATENT DOCUMENTS

| | | | |
|---|---|---|---|
| 2,912,804 | 11/1959 | Simjian | 51/317 |
| 3,596,406 | 9/1971 | McKinney | 209/3 |
| 4,001,984 | 1/1977 | Van Fossen | 51/313 |
| 4,025,419 | 5/1977 | Musschoot | 51/7 |
| 4,244,749 | 1/1981 | Sachs et al. | 134/1 |
| 4,258,505 | 3/1981 | Scheiber et al. | 51/317 |

FOREIGN PATENT DOCUMENTS

| | | | |
|---|---|---|---|
| 2558239 | 6/1977 | Fed. Rep. of Germany | 134/1 |
| 2746699 | 10/1977 | Fed. Rep. of Germany . | |

OTHER PUBLICATIONS

*TRU Waste Decontamination: A Progress Update* (1978–1980) DOE by Battelle Memorial Institute, Jul. 1980.

*Primary Examiner*—Andrew Metz
*Assistant Examiner*—Sharon T. Cohen
*Attorney, Agent, or Firm*—Fay, Sharpe, Beall, Fagan, Minnich & McKee

[57] ABSTRACT

A partition (51, 52, 53) is provided within a vessel (1) for dividing the vessel into two along the vertical direction of the vessel except upper and lower portions thereof. The vessel (1) contains polishing particles (4). A cleaning liquid sprayer (8) is provided in the upper portion of the vessel (1). A discharge opening (2, 3) is provided in a lower portion of the vessel (1) for discharging the cleaning liquid passing through the perforated plate (2). Vibrators (71, 72) are mounted on the brackets (61, 62) to the wall of the vessel (1) for vibrating the vessel so as to generate convection currents of the polishing particles (4) in such a manner that polishing particles flow downward on one side of the partition (51, 52, 53) and upward on the other side thereof.

11 Claims, 3 Drawing Figures

METHOD AND APPARATUS FOR DECONTAMINATING SOLID SURFACE

FIELD OF THE INVENTION

This invention relates to a method and apparatus for decontaminating a solid surface, such as a method and apparatus suitable for use in removing a radioactive substance deposited firmly onto an oxide film formed on a metal surface.

BACKGROUND OF THE INVENTION

Methods of removing a radioactive contaminant from a solid surface can be classified roughly as follows.

(a) Chemical methods

In these methods, the radioactive contaminant is removed from the solid surface based on the solubility of the contaminants in a solvent. In this method, a chemical reaction which increases the solubility or removability of the radioactive contaminant or a substance containing the radioactive contaminant on a solid surface, such as an oxidizing reaction, a reducing reaction, or a complex salt-forming reaction is usually utilized. A combination of a plurality of these reactions is utilized in many cases, these reactions are carried out simultaneously or in series. The chemical methods include a method in which electro-chemical effects are utilized in addition to a method in which the effect of a chemical substance is utilized.

(b) Physical methods

In these methods, a high-speed fluid is brought into contact with the solid surface on which a substance containing the radioactive contaminant is deposited, to remove that substance. A water or air flow is used as the high-speed fluid. Ultrasonically-generated vibrations of water and cavitation are also utilized in some cases.

(c) Mechanical methods

When the radioactive contaminant or a substance containing the radioactive contaminant is attached firmly to the solid surface, or when such a contaminant or substance has occupied a structural cavity on the solid surface or has combined chemically with the surface of such a cavity, it is difficult to remove the contaminant or substance by a chemical or physical method. In this case, the method used is a mechanical method in which a portion of the solid body, which includes the surface thereof, is removed mechanically together with the deposit thereon. Mechanical methods include a method of spraying polishing particles with a fluid onto the solid surface to prevent the secondary spread of the contaminant, a method of vibrating the solid body together with polishing particles to bring them into frictional contact with each other, and a method of melting the solid surface with a plasma arc to remove the contaminant therefrom.

The methods of removing radioactive contaminants from solid surfaces are roughly classified and described above. In practice, the desired object can often be achieved by a suitable combination of these methods. The manner of combining these methods differs according to the purpose of decontaminating the solid surface, or the degree of permission of the influence of the decontamination method used upon the solid. Basically, the method used must not only be capable of removing as much as possible of the contaminant from the solid surface, but also of treating and disposing of secondarily-generated radioactive waste easily.

The fundamental rules for facilitating the treatment and disposal of radioactive waste generated during the decontamination operation (i.e., generated secondarily) are that the selected decontamination method must be able to keep the quantity of secondarily-generated waste to a minimum, and it must be able to keep the chemical properties of the waste suitable for reducing the volume of the waste and stabilizing it.

One preferable conventional method of this kind, selected from this point of view, is a mechanical method in which polishing particles and the solid are vibrated to bring them into frictional contact with each other. This method was studied in the Pacific Northwest Laboratory for the U.S. Government by Battele Memorial Institute, and was reported on in the Nuclear Waste Management Quarterly Progress Reports, page 13.2, right column, line 11, to page 13.3, left column, line 2 of PNL-2378-3 (1978), and page 13.2, right column, lines 3 to 32 of PNL-3000-1 (1979). It has been ascertained that this method is effective for removing a radioactive contaminant deposited on the surface of metals and plastics.

In this reported method, the solid bodies being decontaminated, such as various metal piping members, a casing for a small motor, or small tools, are placed in a vibratory polishing vessel with a polishing medium consisting of sintered ceramic bodies, and the polishing vessel is then vibrated at a rate of 1200/min and an amplitude of 0.25 inch, with an aqueous solution of 10% caustic soda being sprayed from a position above the polishing vessel, and a suspension of the polishing medium containing the radioactive contaminant is discharged from a bottom portion thereof, to decontaminate the solid surfaces.

According to this method, the decontamination of a solid surface continues as the length of the treatment time increases, but the decontamination performance of the polishing medium decreases with the lapse of time. The decontamination performance of the polishing medium reaches a limiting level after a certain period of time, so that the contaminant can no longer be removed effectively to a sufficiently low level.

SUMMARY OF THE INVENTION

An object of the present invention is to provide a method and apparatus for decontaminating a solid surface, which are capable of minimizing as far as possible the decrease with time in the decontamination performance of the polishing particles, and thereby removing the contaminant most effectively to a low level.

The method of decontaminating a solid surface according to the present invention is characterized in that it consists of the steps of flowing a cleaning fluid from a position above the top of a packed layer composed of polishing particles while vibrating the packed layer to generate convection currents of the polishing particles therein, immersing the solid body being decontaminated into a downward-flowing portion of the convection currents of the polishing particles so that the surface of the solid body is polished mechanically by the frictional effect of the polishing particles with respect thereto, and separating the polishing dust from the used polishing particles by a mutual frictional effect thereof during a time in which the used polishing particles flow up toward the top of an upward-flowing portion of the convection currents of the polishing particles while discharging the polishing dust suspended in the cleaning fluid from a lower portion of the packed layer.

The apparatus for decontaminating a solid surface, which is used to practice this method, consists of a vessel containing a packed layer of polishing particles, a partition provided in the vessel so as to extend vertically and divide the entire packed layer except for upper and lower portions thereof into two, a cleaning fluid sprayer provided in an upper portion of the vessel, vibrators for vibrating the vessel so as to generate convection currents of the polishing particles therein in such a manner that the polishing particles flow downward on one side of the partition and upward on the other side thereof, and a discharge means provided in a lower portion of the vessel for discharging the cleaning fluid in which the polishing dust is suspended. A solid body, the object being decontaminated, is immersed in the downward-flowing portion, of the layer of polishing particles, on one side of the partition.

When this construction according to the present invention is employed, the contaminant removed as polishing dust from the surface of the solid body by the polishing effect of the polishing particles in the downward flow thereof is suspended in the cleaning liquid and is carried downward with the downward-flowing portion of the polishing particles. Part of the polishing dust left on the polishing particles is also separated therefrom by the friction generated between the polishing particles, before these polishing particles reach the upper end of the upward-flowing current of the polishing particles, and is then suspended in the cleaning fluid flowing from the upper portion of the vessel. The resultant polishing dust is carried downward with this cleaning liquid and is discharged therewith outside the system. Accordingly, the polishing particles moving from the upward current into the downward current thereof, so as to move toward the solid surface and polish it, are maintained in a fresh and clean state during the operation of the apparatus. Therefore, the decrease with time of the decontamination performance of the polishing particles can be prevented as much as possible.

DETAILED DESCRIPTION OF THE PREFERRED EMBODIMENTS

Figure 1:
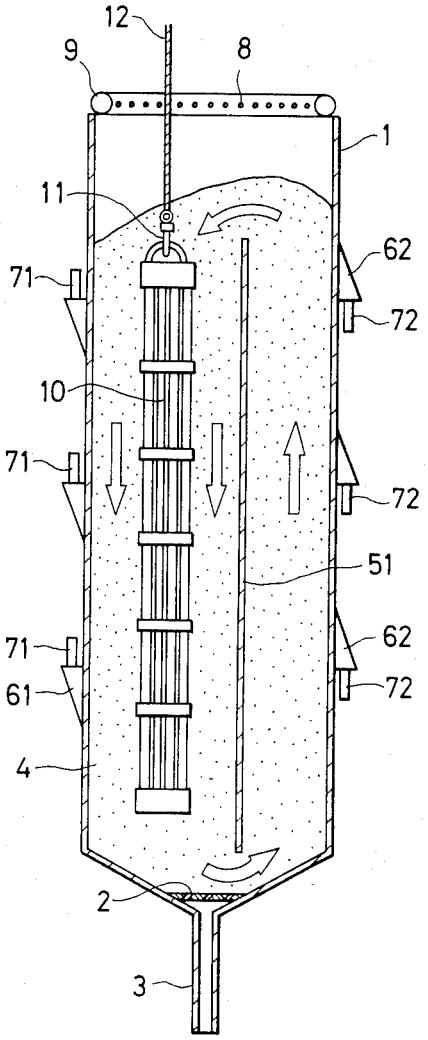
FIG. 1 shows a schematic section of one embodiment of the present invention, in which a sheet or wall is used as a partition within a vessel.

Referring to FIG. 1, a vessel 1 is made of welded stainless steel, and a lower portion of which is connected to a liquid discharge port 3 via a perforated plate 2. The perforated plate 2 lets a cleaning liquid pass therethrough, but not the polishing particles 4 packed in the vessel 1. The interior of the vessel 1, except for upper and lower portions thereof, is divided by a partition wall 51. A plurality of vibrator-mounting members, or the brackets, 61, 62 and a plurality of vibrators 71, 72 are attached to two side walls of the vessel 1. The vibrators 71, 72 are used to apply vibratory forces to the two side walls of the vessel 1 in downward and upward directions, respectively. The vibratory forces may be applied to these walls in diagonal directions if these vibrators 71, 72 can have vertical component parts of downward and upward directions, respectively, along the two side walls of the vessel 1. The vibrators 71 or 72 can be omitted in one side of the vessel 1 to apply the vibratory forces to downward direction or upward direction of the vessel 1. When the vibrators 71, 72 operate, polishing particles flow in the direction of the arrows in FIG. 1. A nozzle tube 9 provided with a plurality of nozzle ports 8 is set on the upper end of the vessel 1, and a cleaning liquid, such as water, is sprayed from a position above a packed layer of polishing particles. An object (a spent nuclear fuel assembly in this embodiment) 10 being decontaminated is suspended by a wire rope 12 on a suspender 11 so that it is held in downward-flowing polishing particles.

To operate the apparatus, the vibrators 71 and 72 are actuated first, so that a packed layer of polishing particles 4 is vibrated and fluidized to make it start flowing in the direction of the arrows. The cleaning liquid is sprayed from the liquid nozzle tube 9 onto the upper surface of the packed layer of polishing particles. The spent nuclear fuel assembly 10 connected to the suspender 11 is then lowered into the downward-flowing current of polishing particles. As a result, the spent fuel assembly 10 displaces the surrounding polishing particles easily and is buried in the packed layer thereof. The polishing particles flow into the gaps as well as between the fuel rods constituting the fuel assembly, and friction and frictional polishing occur between the polishing particles which flow as they are vibrated and the fuel rods or the constituent parts of the fuel assembly.

In general, corrosion products generated in the primary circuit in the nuclear reactor are deposited as insoluble matter on the surfaces of spent fuel assemblies, and these are irradiated with neutrons in the reactor core and become highly radioactive. If these deposits become separated during the handling of the spent fuel assemblies, the contaminants would be spread and become a major cause of the exposure of workers to radiation, so it is desirable to remove the deposits from (decontaminate) the fuel assemblies. However, since each fuel assembly has a plurality of fuel rods of about 1 cm in diameter which are spaced at intervals of a few millimeters and are held in a lattice formation, it is usually difficult to decontaminate the surface of the inner portions of a fuel assembly by a physical or mechanical method.

However, the present invention is designed so that a solid body can be buried in fluidized bed of polishing particles in the above manner so that it is brought into contact therewith, to thereby decontaminate the body mechanically. Therefore, if the diameter of the polishing particles is selected suitably, all the surfaces from the outer portions to the hidden, narrow portions of the solid body can be decontaminated.

Part of the substance (polishing dust) removed off mechanically from the surface of the fuel assembly by the polishing particles brought into frictional contact therewith is deposited on these polishing particles, while another part thereof mixes with the cleaning liquid which flows from the upper portion of the vessel and is suspended therein, the suspension passing through the perforated plate 2 and is discharged. The polishing particles in the downward-flowing current move into the upward-flowing current against the counter current flow of the cleaning liquid. During this time, the polishing particles come into contact frictionally with one another, so that the polishing dust, i.e., the contaminant fixed on the polishing particles, is moved efficiently into the cleaning liquid, the resultant suspension being then discharged. Thus the polishing particles become sufficiently clean by the time they reach the vicinity of the end of the upward current thereof, so that there is little possibility that the already-decontaminated object will be contaminated secondarily by the polishing particles.

The application of the vibratory forces to the vessel and the spraying of the cleaning water onto the polishing particles are done throughout the decontamination time, the length of which is determined with reference to the properties of the contaminant, the degree of contamination of the solid body, and the desired degree of decontamination of the solid body. After this operation is completed, the fuel assembly 10 is withdrawn in a suspended state out of the packed bed of polishing particles while at least the vibrating of the vessel is continued. During this time, the whole system is vibrated, so that substantially no polishing particles are left held in the gaps in the fuel assembly.

The selection of suitable polishing particles is an important factor in executing the decontamination method according to the present invention. The polishing particles preferably have suitable hardness and strength. In order to remove a radioactive contaminant from a solid surface, it is not necessary to grind off part of the solid body, and polishing the solid body excessively should also be avoided. It is not desirable to use polishing particles of an excessively high hardness, they would wear the inner surfaces of the vessel of the decontamination apparatus excessively. On the other hand, if the strength and hardness of the polishing particles were too low, polishing particles themselves would wear, so that polishing particles would be consumed at a high rate, so that the rate of generation of waste containing the radioactive substance would increase.

It is preferable that the polishing particles consist of an inert material. When an object of a complicated shape, such as a spent fuel assembly, is decontaminated, it cannot be guaranteed that no polishing particles remain in the gaps within the solid body. Therefore, it is desirable that the type of polishing particles used does not have any special effect on the after-treatment of the decontaminated solid body, even if polishing particles are left therein. The polishing particles used for decontaminating, for example, a spent nuclear fuel assembly, are preferably such that they can become waste with fragments of cladding tubes and parts of the fuel assembly, without being dissolved in nitric acid in a subsequent treatment step, i.e., a fuel reprocessing step, and so do not cause any increase in the rate of generation of high-level radioactive waste liquor. It is preferable that the size of the polishing particles is selected in accordance with the complexity of the shape of the solid body being decontaminated. If the size of the polishing particles is too large, the polishing particles cannot come into contact with small portions of the solid body being decontaminated. On the other hand, the kinetic energy of the polishing particles generated as they are principally vibrated and the polishing effect thereof decrease in proportion to the mass of the polishing particles. When the diameter of the polishing particles is small and the specific surface area thereof large, the movement of the particles is restricted by surface tension of the liquid flowing therebetween, so that polishing particles of a higher density work more effectively.

The polishing particles perferably have a small specific surface area, i.e., a spherical form, since dynamic friction occurring between them is at a minimum therewith.

It is also desirable to determine suitable conditions for vibrating the vessel to execute the decontamination effectively. The vibrators are preferably compressed air-operated, pulsating high-impact type vibrators. The factors determining the operational conditions for this type of vibrators are period and vibratory force. Period is not necessarily a prime requisite for the practicing of the present invention, the period is preferably short, provided that an impact force of at least a predetermined level can be maintained, to execute the decontamination effectively. When impact forces are applied to opposite side surfaces of the vessel in opposited tangential directions, i.e., in the upward direction on one side surface and in the downward direction on the other, convection currents of polishing particles can be generated.

It is desirable that an upper limit is set for the rate of spraying the cleaning water, in accordance with mainly the water-permeability (which can be determined on the basis of the diameter of the polishing particles alone) of the packed layer of polishing particles, because it is not desirable for carrying out the decontamination properly that all the cavities in the packed layer are filled with the cleaning water. However, conversely, when the supply of cleaning water is reduced, the self-cleaning operation of the polishing particles in the upward-flowing current does not occur properly, and the final decontaminated state of the solid body is impaired.

An embodiment of the present invention, in which radioactive contaminant deposited on a spent nuclear fuel assembly of a boiling water reactor was removed, will now be described.

Details of the fuel assembly are as follows.

| | |
|---|---|
| Lattice array: | 8 × 8 |
| Spacing between fuel rods: | 16.2 mm |
| Material of cladding tubes: | Zircaloy |
| Outer diameter of cladding tubes: | 12.5 mm |
| Outer dimension of fuel assembly: | 114 mm |
| Total length of fuel assembly: | 4330 mm |

The fuel assembly consisted of 63 fuel rods, 1 water rod, upper and lower tie plates, and 7 spacers, and the minimum width of gaps communicated with the interior of the fuel assembly was about 2.7 mm.

The decontamination apparatus was constructed in accordance with FIG. 1. The stainless steel vessel 1 had an effectives cross section of 30 cm×40 cm, and contained a packed bed of polishing particles to an effective depth of about 4.5 m. The polishing particles were stainless steel balls 1.2 mm in diameter, and the capacity of the vessel was about 540 l.

The vibrators used were compressed air-operated high-impact type vibrators, of an operational pressure of 7 kg/cm$^2$ and a vibration frequency of 2400/min. A total of 6 vibrators were attached to the side surfaces of the vessel. When compressed air is supplied to the vibrators 71 consisting of the brackets (61, 62) and the pistons of the vibrators 71, shown in FIG. 1 strike downward along the wall of the vessel 1, then the polishing particles 4 within the vessel 1 move downward along the wall of vessel 1. The pistons of the vibrators 72 strike upward along the wall of vessel 1, when compressed air supplied to the vibrators 72.

Pure water was used as the cleaning water, it was sprayed at 40 l/hour.

The fuel assembly was lowered in a suspended state at a speed of 1 m/min into the packed bed of polishing particles, with the cleaning water sprayed thereonto. The apparatus was then operated for 30 minutes, and the assembly was withdrawn in a suspended state from the packed bed at the same speed as the lowering speed. No polishing particles were found in the gaps in the interior of the fuel assembly thus withdrawn from the packed bed.

It was confirmed that reddish-brown corrosion products from the primary circuit in the nuclear reactor, which had been deposited on the surfaces of the fuel assembly before it was decontaminated, were removed by this treatment. The results of measurements showed that the weight of the decontaminated fuel assembly was reduced by about 100 g.

The quantity of waste liquor generated during this experiment, containing a slurry of the corrosion products, was about 30 l, and this waste liquor was held in a tank provided under the vessel. The slurry in the tank was allowed to settle for 24 hours, so that it separated into a sludge deposited in the bottom of the tank and a supernatant liquor which occupied the greater part of the slurry. The supernatant liquor was concentrated by evaporation, and the sludge was solidified by mixing cement therewith.

In this embodiment, a spent nuclear fuel assembly was decontaminated. The present invention is not limited to this embodiment, it can also be used for decontaminating any objects which are extremely radioactive, or of which surface contamination should preferably by avoided, such as various articles inserted into a nuclear reactor, or canisters of vitrified high-level waste liquor.

In order to practice the present invention, vibrators which are usually employed for pouring concrete can be utilized in addition; these vibrators can be inserted especially in the upward-flowing portion of the packed layer of polishing particles, to promote the movement of the particles. A screw type agitator can also be provided especially in the upward-flowing portion of the polishing particles to promote the movement thereof. The present invention can be practiced in various other modes, by using a cleaning liquid consisting of cleaning water to which a decontamination-promoting chemical is added, or by using non-spherical polishing particles, or by using polishing particles consisting of a material with a high abrasion-resistance.

It is needless to say that the present invention can be used, not only to decontaminate a solid surface contaminated with radioactivity from a nuclear plant, but also to remove contaminants from the surfaces of various other types of solid bodies. The vessel 1 applied to the present invention is not only limited to one unitary body, but also applied to multi-assembled body, if the convection currents of the polishing particles could be carried out as mentioned above.

Figure 2:
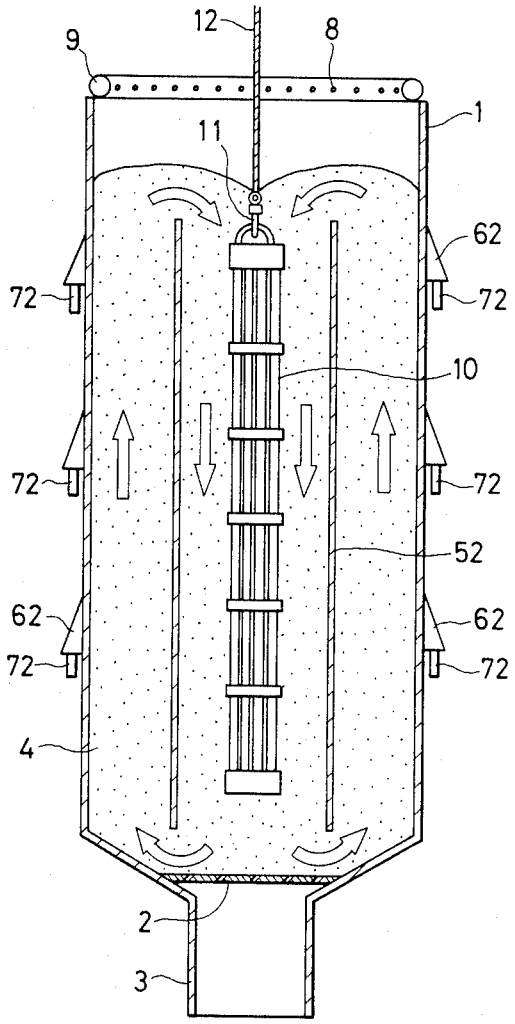
FIG. 2 shows a schematic section of other embodiment of the present invention, in which a tube is used as a partition within a vessel.

Referring to FIG. 2, a tube 52 is located inside the vessel 1. The tube 52 is used as well as a partition wall 51 as shown in FIG. 1.

When the vibrators 72 apply the vibratory forces to the wall of the vessel 1, the polishing particles 4 between the wall of the vessel 1 and the tube 52 move upward direction, and then move downward direction through the inside of the tube 52. Then the convection currents of the polishing particles 4 as well as the removal of the radioactive contaminant from a solid surface are carried out in the same manner mentioned in FIG. 1.

Figure 3:
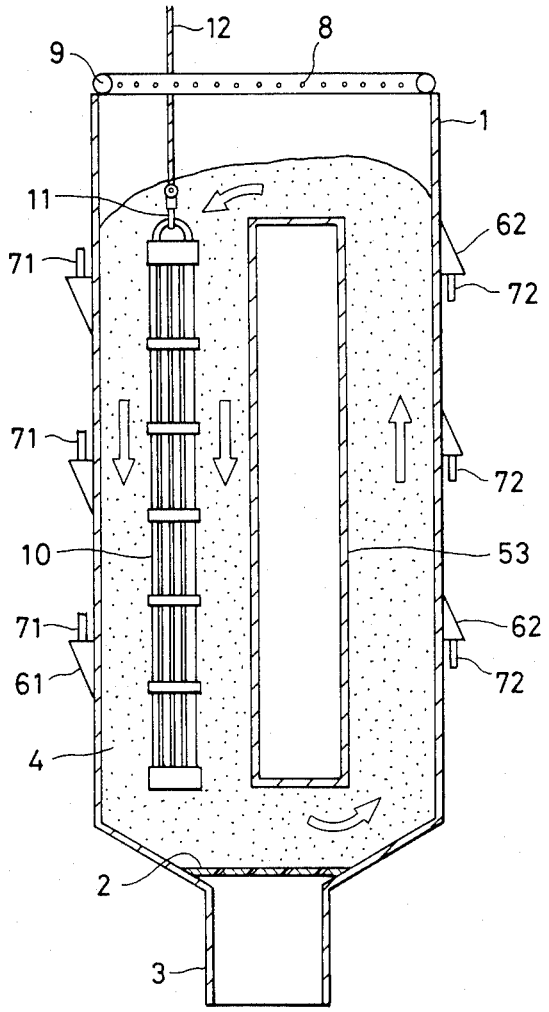
FIG. 3 shows a schematic section of another embodiment of the present invention, in which a cylinder is used as a partition within a vessel.

Referring to FIG. 3, a cylinder 53 is located inside the vessel 1. The cylinder 53 is used as well as a partition wall 51 as shown in FIG. 1.

When the vibrators 71 and 72 apply the vibratory forces to the wall of the vessel 1, the polishing particles 4 between the wall of the vessel 1 and the cylinder 53 move downward and upward directions as shown by arrows through the wall of the vessel 1 and the cylinder 53. Then the convection currents of the polishing particles 4 as well as the removal of the radioactive contaminant from a solid surface are carried out in the same manner mentioned in FIG. 1.

According to the present invention, the following effects can be obtained.

(1) A wide range of wide to narrow surfaces of an object that has a complex shape, such as a fuel assembly of a nuclear reactor, can be decontaminated.

(2) Even substances adhering firmly to a solid surface can be removed, and the density of the residual contaminant of a solid surface can be reduced efficiently.

(3) During the operation of the decontamination apparatus, the removal of the contaminant from the surface of an object by polishing particles and the cleaning of the polishing particles themselves can be done simultaneously and continuously within a single packed bed of polishing particles. Accordingly, the reduction with time of the contaminant-removal capacity of the apparatus can be minimized, and, therefore, contaminants can be removed very effectively to a low level.

(4) The waste by-product is a slurry which can be easily separated into a supernatant liquor and a sludge whose volume can be reduced to provide solids. The rate of generation of waste liquor is low.

(5) The only moving parts of the apparatus are the vibrators. Since simply-constructed vibrators can be used satisfactorily, the apparatus as a whole can be constructed robustly, and frequent maintenance inspections of the apparatus are not necessary.

(6) Even when a highly-radioactive solid body, such as a spent nuclear fuel assembly or the like, is decontaminated, the apparatus can be remotely controlled easily, without exposing the operator to radiation.

What we claim:

1. A method of decontaminating a solid surface with a recirculating bed comprising:

providing a packed bed of polishing particles within a vessel;

providing a vertical partition with top and bottom ends spaced from the top and bottom of the vessel respectively to thereby divide the packed bed into a vertically oriented loop shaped bed surrounding the partition so that the loop-shaped bed has first and second vertical bed sections, and upper and lower bed portions respectively above and below the partition;

immersing a contaminated solid body into the packed bed in the first section of the vessel;

applying downwardly directed vibrations to said first vertical bed section while applying upwardly directed vibrations to the second vertical bed section of the bed;

moving the polishing particles by the downwardly directed vibrations to flow downwardly to mechanically and frictionally polish the surface of said body in said first section and produce polishing dust, and then moving the polishing particles by the vibrations to flow from the first to the second sections around the bottom end of the partition in the lower bed portion, then moving the polishing articles by the upwardly directed vibrations to flow upwardly in said second section to clean said particles by mechanically and frictionally removing the polishing dust from the particles by mutual friction, and then moving the particles by the vibrations to flow from the second to the first sections around the top end of the partition in the upper bed portion;

spraying a cleaning liquid from a position above said packed bed to flow downwardly through both sections to remove polishing dust from the packed bed;

removing the cleaning fluid containing polishing dust from the lower portion of the vessel; and thereby recycling clean polishing particles to the first section through the upper bed portion.

2. A method according to claim 6, wherein said steps of applying vibrations is conducted during said step of immersing the contaminated solid body into the packed bed for decontamination and also during a step of removing the polished body from the packed bed after decontamination.

3. A method according to claim 1 wherein said step of providing a packed bed of polishing particles provides polishing particles having a spherical form.

4. An apparatus according to claim 1 wherein the vibrating means are compressed air-operated, pulsating high-impact type vibrators.

5. A method according to claim 1 wherein said step of providing a packed bed of polishing particles provides the polishing particles as stainless steel balls having a diameter of approximately 1.2 millimeters.

6. A method according to claim 1 wherein said step of spraying sprays the cleaning liquid as water sprayed at about 40 lit./hour.

7. An apparatus having a recirculating bed for decontaminating solid surfaces comprising:

a vessel having a top and bottom; said bed containing a packed bed of polishing particles;

a vertical partition means spaced from the top and bottom of the vessel for dividing the packed bed into a vertically oriented loop shaped bed surrounding the partition means said bed having first and second bed sections, and upper and lower bed portions respectively above and below said partition means;

at least one vibrating means for applying downwardly directed vibrations to the first section of the bed for causing the polishing particles within said first section to flow downward; at least one vibrating means for applying upwardly directed vibrations to the second section of the bed for causing the polishing particles within said second section to flow upward; and both said vibrating means for further applying vibrations to said upper and said lower bed portions so that the polishing particles flow from said first section to said second section through said lower bed portion and from said second section to said first section through said upper bed portion;

means to supply cleaning liquid to said bed from a position above the packed bed; and means to remove cleaning liquid from a position below said packed bed; wherein the polishing particles move downward in said first section, through said lower bed portion and into the second section, upward in said second section, through said upper bed portion and into the first section for reuse.

8. A method according to claim 1, wherein said step of spraying a cleaning liquid includes spraying water as the cleaning liquid.

9. An apparatus according to claim 7, characterized in that said partition means comprises a sheet of wall.

10. An apparatus according to claim 7, characterized in that said partition means comprises a tube forming said first section, wherein said polishing particles between the wall of said vessel and said tube move in the upward direction of said vessel and said particles within said tube move in the downward direction of said vessel by applying the vibrations of said vibrating means.

11. An apparatus according to claim 7, characterized in that said partition means comprises a cylinder (4), wherein said polishing particles (4) flow downward on one side of said cylinder and upward on the other side thereof.

* * * * *